US006089036A

United States Patent [19]

Carlson et al.

[11] Patent Number: 6,089,036

[45] Date of Patent: Jul. 18, 2000

[54] OPEN-TOP CHILLING APPARATUS

[75] Inventors: Terry Carlson, Eau Claire; William J. Knapp, Sawyer; Alois Weisser, Stevensville, all of Mich.

[73] Assignee: Stanley Knight Corporation, New Troy, Mich.

[21] Appl. No.: 09/146,026

[22] Filed: Sep. 2, 1998

Related U.S. Application Data

[60] Provisional application No. 60/057,532, Sep. 4, 1997.

[51] Int. Cl.[7] ..... A47F 3/04

[52] U.S. Cl. ..... 62/256; 62/258

[58] Field of Search ..... 62/89, 256, 258

[56] References Cited

U.S. PATENT DOCUMENTS

| | | | |
|---|---|---|---|
| 2,631,438 | 3/1953 | Weber | 62/256 |
| 3,324,676 | 6/1967 | Gerweck | 62/256 |
| 3,531,945 | 10/1970 | Brennan | 62/256 |
| 4,109,484 | 8/1978 | Cunningham | 62/256 |
| 4,300,358 | 11/1981 | Hino et al. | 62/256 |
| 4,373,355 | 2/1983 | Monroe | 62/256 |
| 4,651,536 | 3/1987 | Nax | 62/256 |
| 4,802,340 | 2/1989 | Johnson | 62/258 |
| 4,807,446 | 2/1989 | Sunaga | 62/256 |
| 5,009,080 | 4/1991 | Naganuma et al. | 62/256 |
| 5,168,719 | 12/1992 | Branz et al. | 62/258 |
| 5,282,367 | 2/1994 | Moore et al. | 62/256 |

*Primary Examiner*—William E. Tapolcai

*Attorney, Agent, or Firm*—Rader, Fishman, Grauer & McGarry, an office of Rader, Fishman & Grauer

[57] ABSTRACT

A refrigerated food preparation table having a food preparation surface, a refrigerated food storage chamber, and a food plenum chamber adjacent to the food preparation surface. An air baffle assembly including a venturi restriction creates a resilient and uniform cool air curtain distributed across the top of food bins disposed within the food plenum chamber. One portion of the returning airflow, which is relatively warmer, having been exposed to higher ambient temperatures, circulates around the food bins and another portion of the returning airflow cools the refrigerated food storage chamber before entering a refrigeration coil/blower chamber to begin the cycle anew. The configuration maintains foodstuffs within the unit between 32° and 40° F.

54 Claims, 5 Drawing Sheets

OPEN-TOP CHILLING APPARATUS

RELATED APPLICATION

This application claims the benefit of U.S. Provisional Patent Application No. 60/057,532, which was filed Sep. 4, 1997.

BACKGROUND OF THE INVENTION

1. Field of the Invention

This invention relates to refrigerated food preparation tables, and more particularly, to such a table having a refrigerated food storage chamber, a food preparation surface adjacent to food bins disposed within an open-top food plenum chamber, and an air baffle assembly having a venturi restriction.

2. Description of the Related Art

Food preparation tables generally have open-top refrigerated compartments for accessing food bins. These compartments are held open to warmer ambient air for many hours by food service workers preparing goods such as pizza or sandwiches. Hence, it is desirable to keep foodstuffs in the refrigerated compartment within a desirable temperature range that prevents spoilage as well as freezing, and meets the standards promulgated by the National Sanitation Foundation. This temperature range lies between 32° F. and 40° F.

Devices which rely on cold wall refrigeration enclosures for cooling the foodstuffs are prone to produce undesirable temperature gradients in the foodstuffs. These gradients cause portions of the foodstuffs to become frozen in order to keep other portions of the foodstuffs at acceptable cooling temperatures.

A number of devices employ forced air circulation around the food bin. Examples of such devices are described in U.S. Pat. No. 5,168,719 to Branz et al. and U.S. Pat. No. 5,282,367 to Moore et al. In the Moore device, a warmer airflow is forced towards the bottom of food containers, and another cooler airflow is forced through a laminar air screen and across the top of the food containers. According to one embodiment of the device of Branz et al., air which is cooled at one end of the table flows along the entire length of the table within an elongated cool air supply duct before circulating around condiment pans. In another embodiment, cooled air leaving the evaporator area is immediately diverted towards the back ends of the condiment pans as well as across the top of the condiment pans. The warmer returning airflow generally reaches only the front ends of the condiment pans.

Movement of cooled air over long distances is inefficient. Moreover, forced air systems can suffer erratic temperature gradients because of the difficulty of evenly distributing the cooled air throughout the entirety of the refrigerated space.

SUMMARY OF THE INVENTION

The disadvantages and problems of the prior art refrigeration systems are addressed according to the invention by an open-top chilling apparatus that maintains food items at a chilled temperature less than the surrounding ambient air temperature while providing convenient access to the food items. The open-top chilling apparatus comprises a housing that defines a plenum chamber. The housing has an open top through which access is provided to the plenum chamber and which fluidly connects the plenum chamber to the ambient air. A food container having a peripheral wall with an upper edge defining an open face is mounted to the housing within the plenum chamber so that the open face is accessible through the open top of the housing. This arrangement permits access to the food the container through the open top. A chilled-air source for supplying chilled air to the plenum chamber is provided in the housing. A chilled-air conduit extends from the chilled-air source to the plenum chamber to carry chilled air into the plenum chamber. The chilled-air conduit has in inlet opening fluidly connected to the chilled-air source and a discharge opening near the open face of the food container to direct at least a portion of the chilled air across the open face of the food container. A venturi chamber is provided in the chilled-air conduit to accelerate the chilled air in the conduit so that the speed of the chilled air exiting the conduit discharge opening is greater than the speed of the chilled air entering the chilled-air conduit inlet opening whereby the accelerated chilled air exiting the chilled-air discharge opening forms a curtain of accelerated chilled air across the open face of the food container to effectively separate the ambient air outside the housing from the chilled air within the plenum chamber.

Preferably, the open-top chilling apparatus further comprises a return conduit having an inlet near the open face of the food container and an outlet in fluid communication with the chilled-air source whereby the accelerated chilled air passing over the open face of the food container is recirculated through the chilled-air source, the chilled-air source is preferably a traditional refrigeration unit provided within the housing. The venturi chamber can be a portion of the chilled-air conduit having a reduced cross sectional area. The portion of reduced cross-sectional area can have a continuously decreasing cross-sectional area and can be positioned at the discharge opening of the chilled-air conduit.

The housing is preferably formed of elongated front and rear walls connected by opposing end walls to define the plenum chamber. Each of the walls terminates in an upper edge to define the open top. The chilled-air inlet opening is adjacent to and spans only a portion of the rear wall. The chilled-air conduit further comprises an air diffuser positioned between the chilled-air inlet opening and the chilled-air discharge opening to laterally direct the chilled air across a greater span of the rear wall than the span of the inlet opening. The air diffuser preferably comprises multiple fins extending away from the inlet opening in a fan-shaped pattern with their terminal ends being connected to a top plate having multiple exit apertures through which the laterally directed chilled air exits from the diffuser and into the venturi chamber.

The open-top chilling apparatus can additionally include an air deflector positioned within the plenum chamber. The air deflector comprises a front side and a rear side connected by a bottom wall. The front sided and rear side have upper edges. The front side upper edge supports the front wall portion of a food container and the rear side upper edge extends at least partially up the rear wall of the food container. The deflector front side can be spaced from the housing front wall to define the return conduit. Similarly, the deflector rear side can be spaced from the housing rear wall to form a portion of the venturi chamber. At least one portion of the deflector rear side in the housing rear wall converge relative toward each other to define the continuously reducing cross-sectional area of the venturi chamber.

The housing preferably includes a chilled storage area positioned below the plenum chamber and having an access opening that is closed by a moveable door. Additionally, a work surface can be mounted to the housing above the chilled storage access area opening and extending away from the housing chamber front wall.

Another aspect of the invention includes a refrigerated food preparation table for maintaining food items at a temperature less than the ambient air temperature while maintaining convenient access the food items. The refrigerated food preparation table comprises a housing having a base supporting an upper portion with elongated front and rear walls connected by end walls to define a plenum chamber. Each of the walls terminates an upper edge to define an open top through which access is provided to the plenum chamber and which fluidly connects to the ambient air. A food container is provided in the plenum chamber with an open face and mounted to the housing within the plenum chamber so that the open face is accessible through the open top of the housing thereby permitting access to the food container through the open top. A food preparation surface extends from the housing and a refrigeration unit is provided in the base for supplying chilled air to the plenum chamber. The refrigeration unit is fluidly connected to the plenum chamber by a chilled-air conduit. The chilled-air conduit comprises a discharge opening near the open face of the food container to direct at least a portion of the chilled air across the open face of the food container. A venturi chamber is provided in the chilled-air conduit to accelerate the chilled air in the chilled-air conduit so that the speed of the chilled air exiting the chilled-air discharge opening is greater than the speed of the chilled air entering the chilled-air conduit inlet opening whereby the accelerating chilled air exiting the chilled-air discharged opening forms a curtain of accelerated chilled air across the open face of the food container to effectively fluidly separate the ambient air outside the housing from the chilled air within the plenum chamber.

In another embodiment, the invention comprises a method for chilling food items in a refrigerated food preparation table comprising a housing having a base supporting an upper portion with elongated front and rear walls connected by end walls to define a plenum chamber. Each of the walls terminates in an upper edged to define an open top providing access to the plenum chamber and fluidly connecting the plenum chamber to the ambient air. A food container is provided in the plenum chamber and has an open face. The food container is mounted to the housing within the plenum chamber so that the open face is accessible through the open top of the housing thereby permitting access to the food container through the open top. A refrigeration unit is provided in the base for supplying chilled air to the plenum chamber. A chilled-air conduit extends from the refrigeration unit to the plenum chamber. The chilled-air conduit has an inlet opening fluidly connected to the refrigeration unit in a discharge opening near the open face of the food container to direct at least a portion of the chilled air across the open face of the food container. The method of chilling food items comprises forcing the chilled air from the refrigeration unit through the chilled-air conduit and across the open face of the food container and accelerating the chilled air within the chilled-air conduit to form an air curtain across the open face of the food container.

Other objects, features, and advantages of the invention will be apparent from the ensuing description in conjunction with the accompanying drawings.

DETAILED DESCRIPTION OF THE PREFERRED EMBODIMENT

Figure 1:
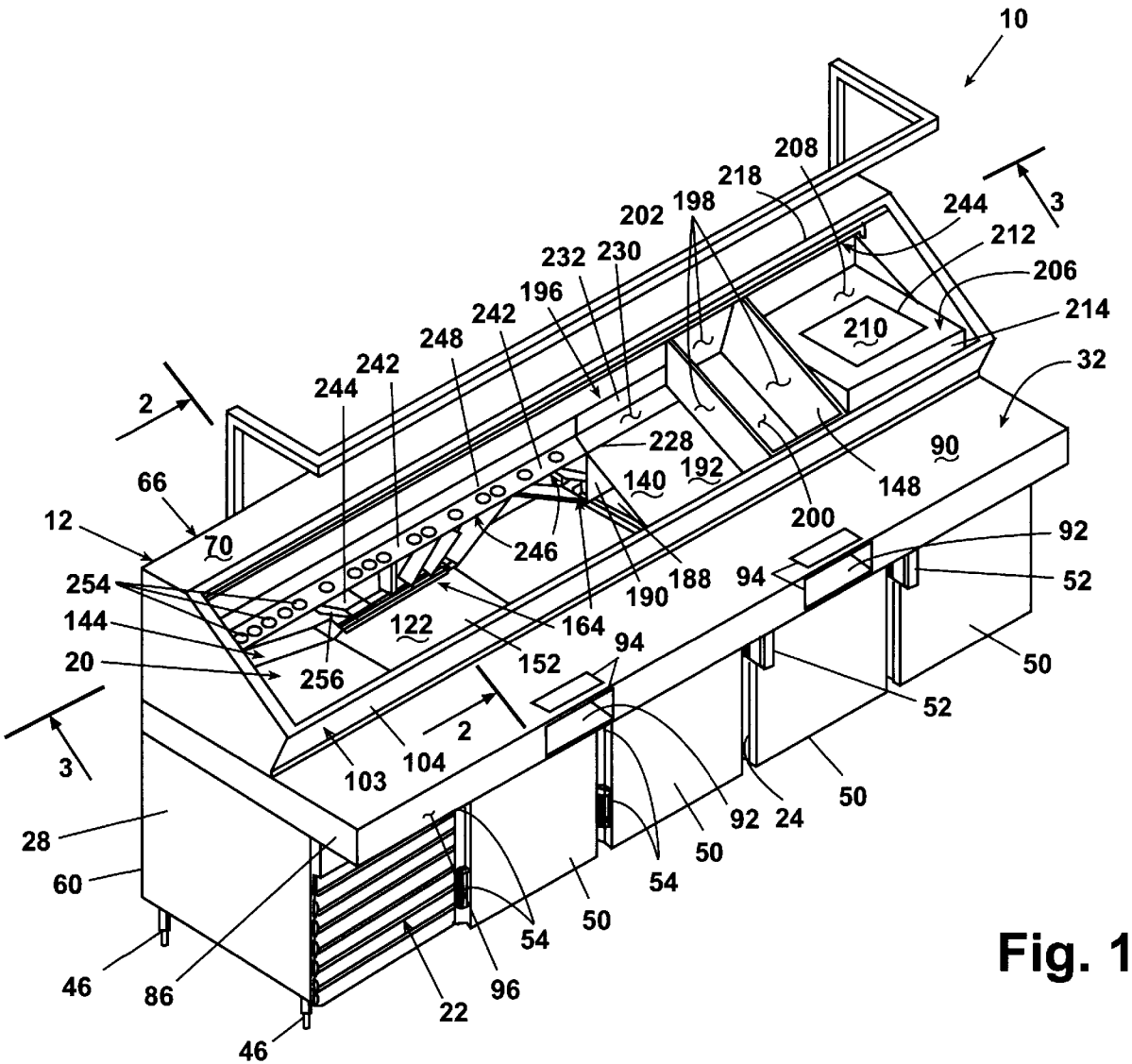
FIG. 1 is a front, perspective view of an open-top refrigerated food processing table according to the invention.

Referring to FIGS. 1–4 of the drawings, there is shown an open-top chilling apparatus in the form of an open-top refrigerated food processing table 10, which comprises a housing 12, an air baffle assembly 14, a cooling assembly 16, a refrigerated base chamber 18, a food plenum chamber 20, and a heat pump chamber 22.

The housing 12 includes a front wall 24, a rear wall 26, sidewalls 28, a bottom wall 30, and a food preparation surface 32.

Each of the housing walls 24, 26, 28, 30 is formed by sandwiching insulation between a pair of metal panels, preferably comprising stainless steel sheet. For example, referring to FIG. 2, the front housing wall 24 is formed by a front outer wall panel 56, a corresponding front inner wall panel 36, and thermal insulation 44 disposed therebetween. Similarly, the rear housing wall 26 comprises a rear outer wall panel 58, a corresponding rear inner wall panel 38, and insulation 44 disposed therebetween, and so on. The double walls so formed are interconnected to form a cabinet-like structure supported above the floor by a plurality of legs or casters 46 mounted on the bottom housing wall 30.

Each of a plurality of apertures 48 formed in the front housing wall 24 is closed by a respective one of an equal plurality of doors 50. The doors, like the walls of the housing, are preferably formed of stainless steel and provided with thermal insulation 44. Each door carries a handle 52 and is mounted on the front housing wall by means of hinges 54, whereby it can be opened to provide access to the refrigerated base chamber 18.

The rear housing wall 26 extends upwardly beyond the front wall 24 and projects inwardly towards the front wall to form an overhanging canopy 66. More particularly, the canopy 66 is defined by a horizontal portion 70 thereof interconnected at a right angle to the rear outer wall panel 58. The rear inner wall panel 38 extends upwardly and forms a shoulder 72, where it may terminate or continue upwardly alongside the rear outer wall panel 58, as shown, to cooperate therewith to form the canopy 66.

The food preparation surface or countertop 32 of the housing 12 is located at the front of the refrigerated food preparation table 10, where it juts outwardly beyond the front housing wall 24 and extends lengthwise along the unit. More particularly, the countertop 32 is mounted atop the front wall 24 and includes a cantilevered or overhanging outer portion 86, which terminates in an end wall 96, and an inner insulated portion 88. The portions 86, 88 are joined to provide a continuous horizontal surface 90 positioned at a height convenient for a person preparing food. The surface 90 is preferably formed of stainless steel to function as a cutting board and provide a large general work area.

Supply chambers 92 are formed within the overhanging portion 86 of the countertop 32. Supply chamber openings 94 are formed in either or both of the horizontal surface 90 and the end wall 96 and provide access to the supply chambers for the storage of paper bags, utensils, or containers.

The insulated portion 88 of the countertop extends lengthwise along the open-top refrigerated food processing table 10 and is formed with a support surface 114 and a horizontal lower surface 98 interconnected by a vertical step 116. The countertop portion 88 is mounted on the front housing wall 24 at the support surface 114. Integrally formed with the countertop portion 88 and extending from its inner edge is a flange 103 having an outer surface 104, an inner surface 106, and a top edge 108. A vertical inner end surface 110 of the countertop portion 88 joins the inner surface 106 of the flange 103 and the horizontal lower surface 98. Similarly a fillet surface 118 joins the outer surface 104 of the flange 103 and a rearward portion 102 of the countertop surface 90. The flange 103 extends upwardly and outwardly from the surface portion 102 and forms an acute angle therewith. The horizontal and vertical lower surfaces 98, 110 are exposed to the refrigerated base chamber 18, and a light fixture 100 is mounted on the horizontal lower surface 98.

The housing sidewalls 28 are interconnected with the bottom housing wall 30, rear housing wall 26, and front housing wall 24 and extend upwardly beyond the horizontal surface 90 of the countertop 32. The sidewalls 28 conform to and abut the rear wall 26, canopy 66, and flange 103.

The refrigerated base chamber 18 is defined by the bottom housing wall 30, the rear housing wall 26, the front housing wall 24, the vertical step 116 of the insulated portion 88 of the countertop 32, the horizontal lower surface 98 of the insulated portion 88 of the countertop 32, a rail liner 122, a respective one of the insulated housing sidewalls 28 at one end of the chamber 18 and an insulated vertical end wall 120 at its other end. The refrigerated base chamber 18 is disposed beneath the food preparation surface 32 and the food plenum chamber 20 and serves as a food storage compartment.

The food plenum chamber 20 also serves as a food storage compartment and is disposed adjacent to the food preparation surface 32, being defined by a rail liner 122, the inner surface 106 of the flange 103, and a top cover 34. The top cover includes a rectangular hood 132. The top cover 34 includes a hinged end 124 pivotally mounted on a hinge support 128 which is affixed to the horizontal portion 70 of the canopy 66. In the closed position, a free end 126 of the top cover 34 rests against the top edge 108 of the flange 103. A handle 130 is provided for ease of opening the top cover 34 to gain access to the interior of the food plenum chamber 20. Multiple top covers may be provided for selective access to the chamber 20.

The major portion of the air baffle assembly 14 is disposed within the food plenum chamber 20, which is configured to receive a plurality of open-top condiment bins or food bins 148 which hold foodstuffs used by the food preparer to assemble food servings on the countertop 32. Each food bin 148 has four upright walls 198 interconnected with a bottom wall 200. A lip 202 is formed along the top surface of each bin 148, and a support rod 204 is provided for supporting the back end of the food bins 148 inside the food plenum chamber 20. A portion of the lip 202 at the front of the food bin 148 is supported by an air deflector panel 140. When disposed within the food plenum chamber 20, the bin 148 is angled towards the front of the unit 10. Such angled support means may reduce the liquid capacity within the bins 148.

Figure 7:
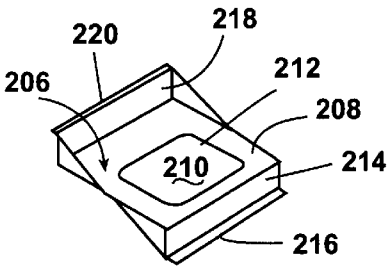
FIG. 7 is a front, perspective view of a saucepan insert according to the invention.
Figure 6:
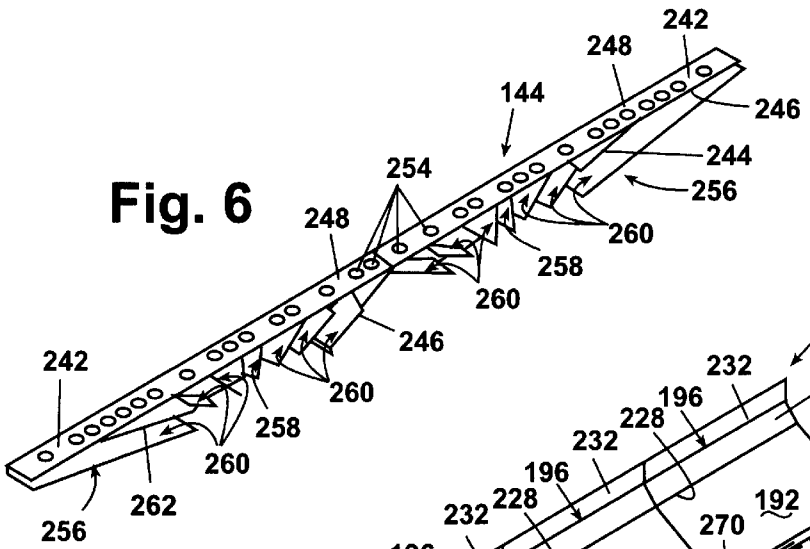
FIG. 6 is a front, perspective view of air diffusers also forming a subassembly of the refrigerated food processing table of FIGS. 1–5.
Figure 5:
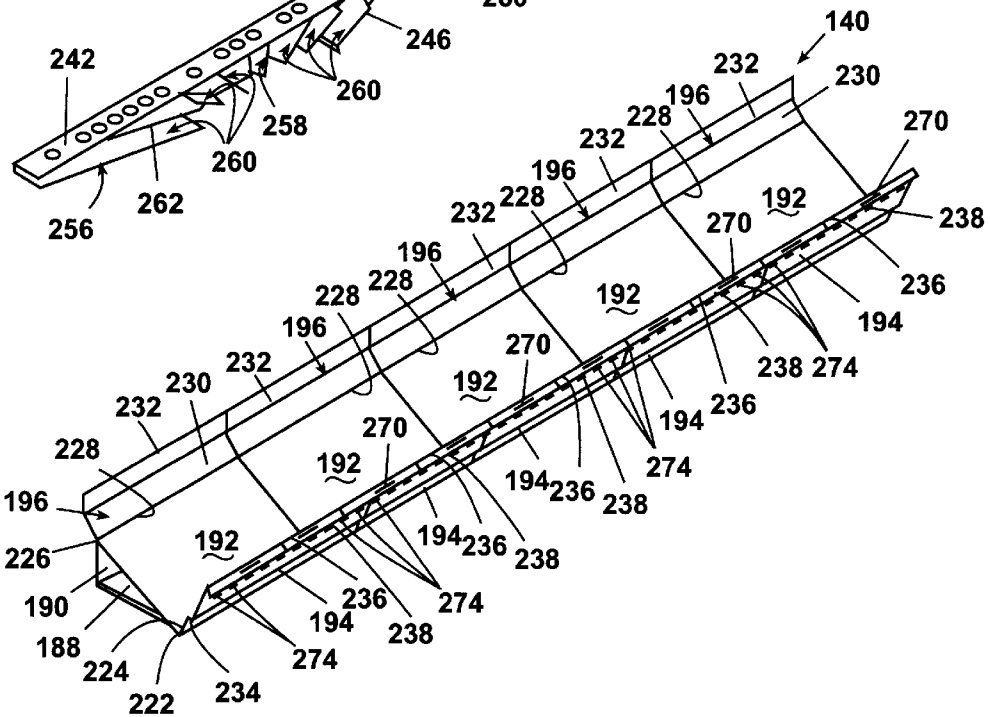
FIG. 5 is a front, perspective view of a contiguous series of air deflector panels forming a subassembly of the refrigerated food processing table of FIGS. 1–4.

Alternatively, a saucepan insert 206, as shown in FIG. 7, may be used in lieu of food bin 148 for holding liquid foodstuffs. The saucepan insert 206 includes a substantially horizontal frame 208 with an opening 210 adapted to support a saucepan 212 when inserted therein. A front wall 214 of the saucepan insert 206, which includes a front lip 216 adapted to rest against the air deflector panel 140, is interconnected by means of the frame 208 with a back wall 218 having a back lip 220 adapted to be supported by the supporting rod 204.

Figure 3:
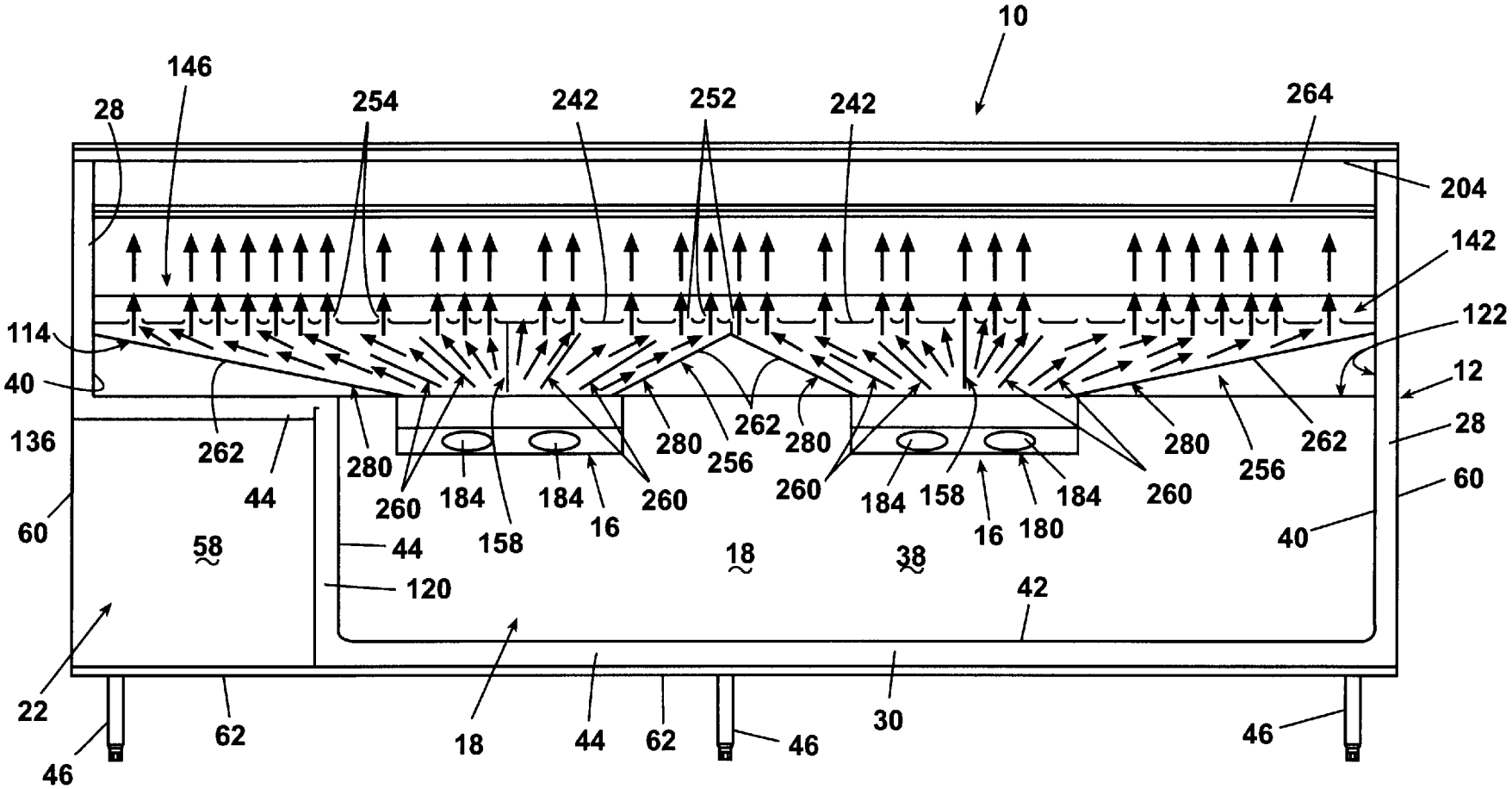
FIG. 3 is a diagrammatic, sectional view of the refrigerated food processing table of FIGS. 1 and 2, taken along line 3—3 of FIG. 1.
Figure 4:
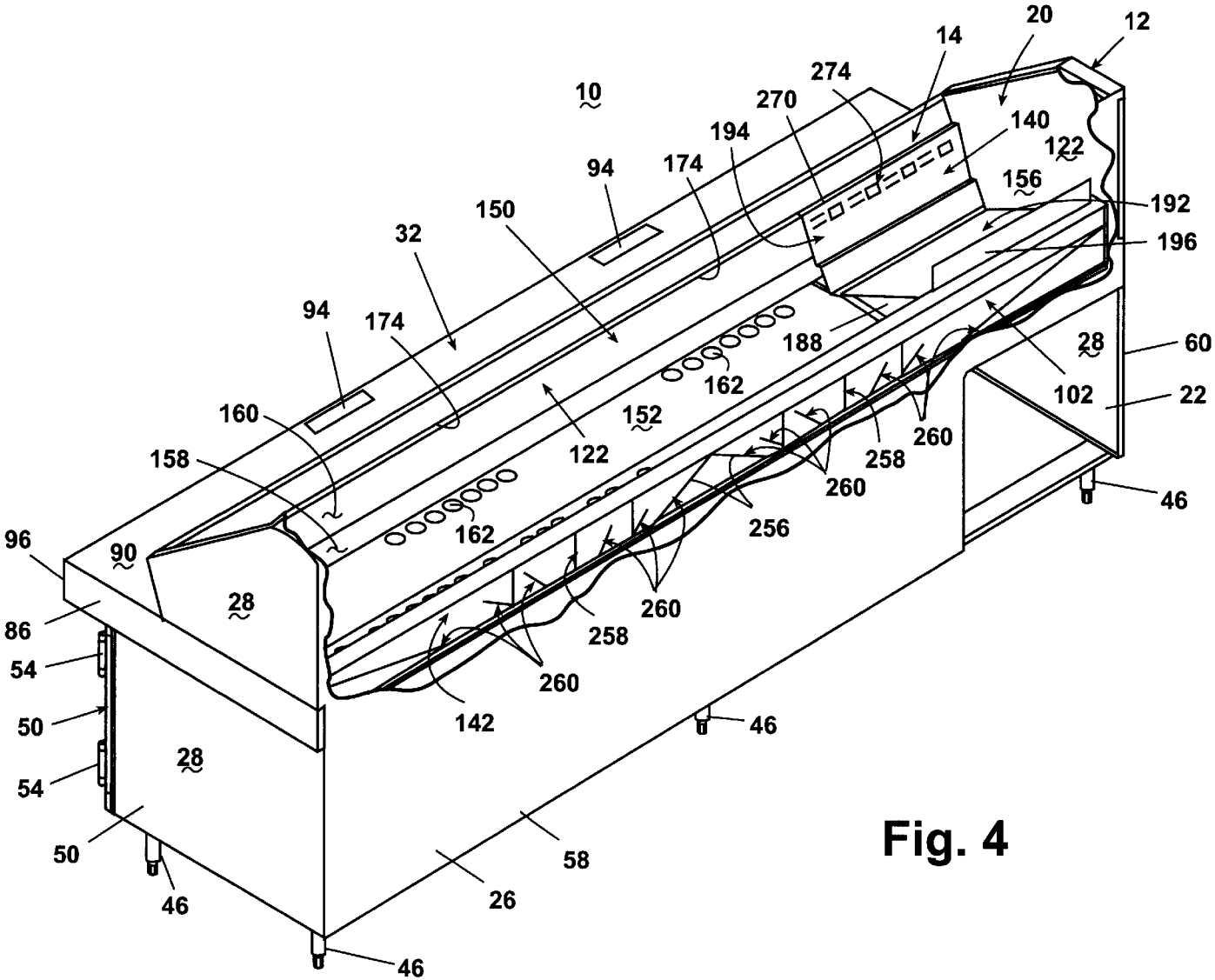
FIG. 4 is a rear, perspective view, partially in section, of the refrigerated food processing table of FIGS. 1–3.

With particular reference to FIG. 3, the heat pump chamber 22 is disposed within the unit 10 and is insulated from the food plenum and refrigerated base chambers 20 and 18. More particularly, the heat pump chamber is defined by the bottom outer wall panel 62, the side outer wall panel 60, the rear outer wall panel 58, the front outer wall panel 56, the insulated vertical end wall 120, and an insulated horizontal wall 136.

The cooling assembly 16 comprises refrigeration equipment (not shown) disposed within the heat pump chamber 22 and within a refrigeration coil/blower chamber 180. A coil/blower chamber(s) 180 is disposed within the refrigerated base chamber 18 so that it abuts the rail liner 122. Each refrigeration coil/blower chamber 180 preferably includes an inlet 184 and an outlet 186. Each chamber 180 houses at least one fan (not shown) and an evaporator (not shown) which are disposed so that air moved by operation of the fan is forced through the evaporator and becomes cooled before exiting the chamber 180. The evaporator carries refrigerant which is returned by way of a tube 182 to the heat pump chamber 22 which houses a condenser, compressor, and a condenser fan (all not shown). The tube 182 may also drain condensate from the refrigeration coil/blower chamber 180.

The air baffle assembly 14 comprises a rail liner 122, coil discharge ducts 138, an air deflector panel 140, a discharge diverter chamber 142, an air diffuser 144, a discharge venturi plenum chamber 146, a plenum return chamber 276, and a pan cooling chamber 278.

The rail liner 122 extends lengthwise along the open-top refrigerated food processing table 10 and includes a front panel 150, a bottom panel 152, a rear panel 154, and end panels 156 interconnected together and preferably formed of sheet metal. The front panel 150 has a substantially vertical portion 158 interconnected to a sloped portion 160 having an end 174. The vertical and sloped portions 158 and 160 correspond with the inner end surface 110 and the inner surface of the flange 106, respectively. The front panel 150 is interconnected to the rear panel 154 by a bottom panel 152. The bottom panel 152 preferably contains a series of circular rail liner return openings 162 positioned towards the front end of the bottom panel 152. Towards the rear end, the bottom panel 152 contains slotted discharge openings 164. The rear panel 154 comprises a vertical portion 166 thereof and a horizontal portion 170 interconnected by a sloped portion 168 corresponding to the rear inner wall panel 38. The horizontal portion 170 has an end 176 and forms a slightly downwardly curved lip 172 conformingly meeting the rear inner wall panel 58. Side panels 156 of the rail liner 122 abut the housing sidewalls 28. The rail liner 122 is disposed within the food plenum chamber 20 and rests atop the shoulder 72. The ends 174 and 176 may be securely mounted on the flange 103 and rear housing wall 26, respectively.

A coil discharge duct 138 generally made from sheet metal is configured to interconnect the outlet 186 of the refrigeration coil/blower chamber 180 with the slotted discharge openings 164.

Another component of the air baffle assembly 14 is the air deflector panel 140 which comprises a horizontal support panel 188, a vertical support panel 190, a sloped base panel 192, a front panel 194, and a rear panel 196. A series of air deflector panels 140 made from sheet metal may be inserted into the food plenum chamber 20 to form a continuous configuration along the length of the unit, and each deflector panel 140 is individually removable for easy maintenance and cleanup.

The horizontal support panel 188 is interconnected at a right angle to the vertical support panel 190. A front end 222 of the horizontal support panel 188 is mounted on a front end 224 of the sloped base panel 192, and a top end 226 of the vertical support panel 190 is mounted on a back end 228 of the sloped base panel 192 so that the vertical and horizontal support panels 188, 190, together with the sloped base panel 192, form a triangular cross section. The rear panel 196 which is connected to the back end 228 of the sloped base panel 192 comprises a sloped portion 230 and a substantially vertical portion 232 interconnected together. The front panel 194 is connected to the sloped base panel 192 at the front end 224 and includes a shoulder 234, a lip 236 extending along a top end 238, and slotted air return openings 240 located along the top end 238.

The air diffuser 144 comprises a top plate 242 with a front end 246, a back end 248, a side plate 244 with a top end 250, a bottom end 252, and double-sloped bottom ends 262. The back end 248 is connected perpendicularly with the top end 250.

A plurality of circular apertures 254 are formed between the front and back ends 246, 248 of the top plate 242. Generally, air diffusers 244 are disposed lengthwise within the unit in a manner such that the bottom end 252 of the side plate 244 abuts the shoulder 72, and the front end 246 of the top plate 242 generally abuts the sloped portion 230 of the rear panel 196 of the air deflector panel 140. A plurality of air fins 256 include a central fin 258, intermediate fins 260, and outer fins 280. The air fins 256 are made from elongated sheet metal strips and are perpendicularly mounted on the side plate 244. Generally, fins are mounted on each side plate 244 and associated with one slotted discharge opening 164. The central fin 258 is mounted perpendicularly to the top plate 242, and the intermediate fins 260 and outer fin 280 on each side of the central fin 258 diverge therefrom with increasing angularity. The outer fins 280 are mounted on the double-sloped bottom ends 262 in abutting relationship therewith.

The discharge diverter chamber 142 is defined by the side plate 244 of the air diffuser 144 on one side, the vertical support panel 190 at the other side, the top plate 242 of the air diffuser 144 at the top, and the shoulder 72, a portion of the rear end of the rail liner 122 including the slotted discharge openings 164 at the bottom, and the end panels 156 of the rail liner 122 on both sides. Air fins 256 of the air diffuser 144 direct air from the discharge openings 164 towards the apertures 254.

The discharge venturi plenum chamber 146 is defined by the end panels 156 of the rail liner 122, the sloped and vertical portions 168 and 166 of the rail liner 122, the sloped and vertical portions 230 and 232 of the rear panel 196 of the air deflector panel 140, a food bin wall 198, the top plate 242 of the air diffuser 144, an outflow opening 266, and a turning vane 264 which is mounted on the sloped portion 168 of the rail liner 122.

The pan cooling chamber 278 is defined by the bin walls 198, the bottom bin walls 200, the front panel 194 of the air deflector panel 140, the end panels 156 of the rail liner 122, the sloped base panel 192 of the air deflector panel 140, and the rear panel 196 of the air deflector panel 140.

The return plenum chamber 276 is defined by the front panel 194 of the air deflector panel 140, the vertical portion 158 of the front panel 150 of the rail liner 122, the front end of the bottom panel 152 of the rail liner 122, and the end panels 156 of the rail liner 122.

Figure 2:
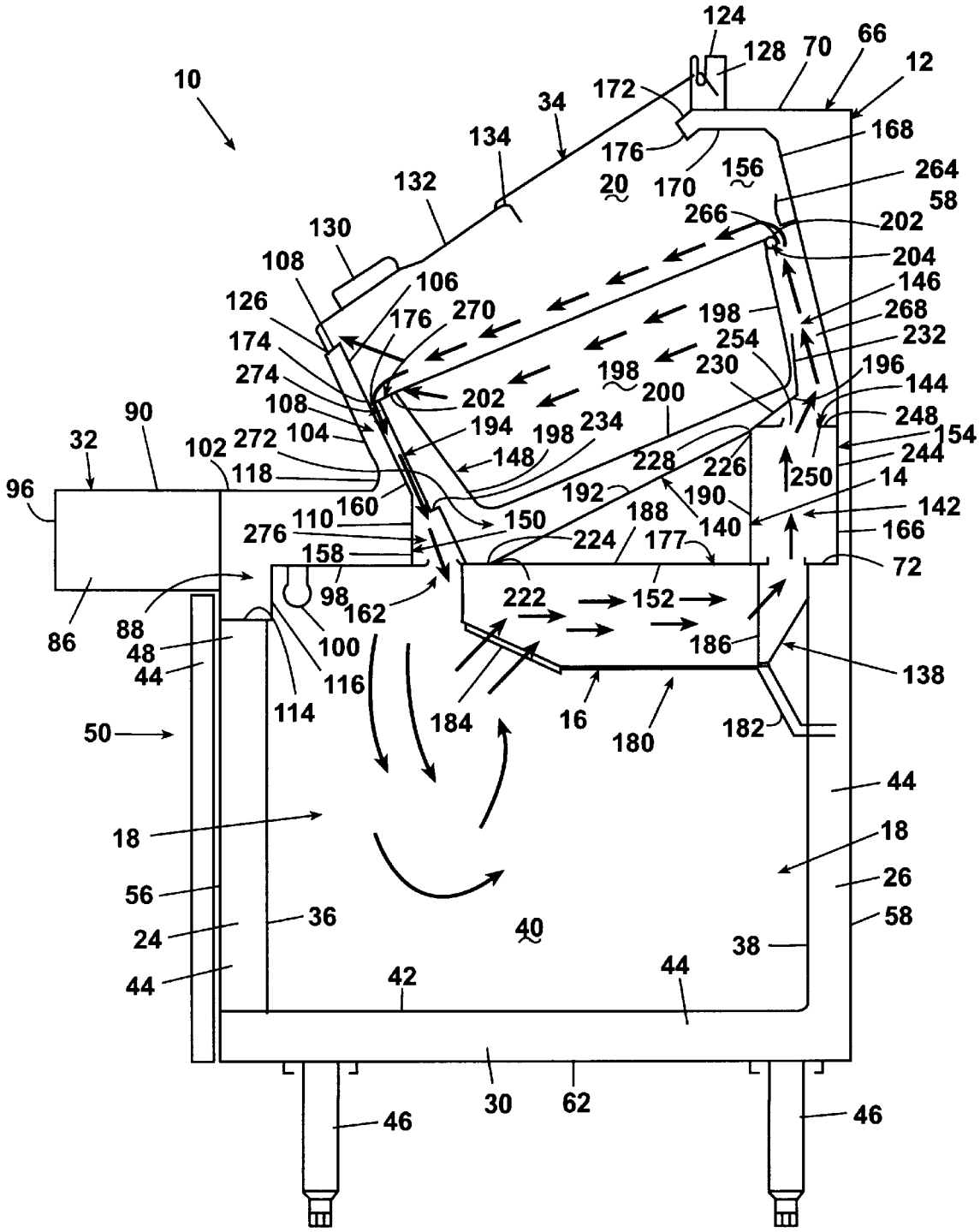
FIG. 2 is a diagrammatic, sectional view of the refrigerated food processing table of FIG. 1, taken along line 2—2 thereof.

As indicated by the directional arrows in FIGS. 2 and 3, air is forced by a fan (not shown) located within the coil/blower chamber 180 through evaporator coils and is cooled before exiting the chamber 180 at the outlet 186. The cooled air is forced through the slotted discharge openings 164 and into the discharge diverter chamber 142 by way of the coil discharge ducts 138. The air inside the discharge diverter chamber 142 is diffused and distributed lengthwise by air fins 256 and then directed through apertures 254 in the top plate 242 of the air diffuser 144. The resulting uniformly distributed column of air enters the discharge venturi plenum chamber 146 wherein the airflow passes through a constricted area 268 formed by the sloped and vertical panels 230, 232 of the air deflector panel 140 and the vertical and sloped portions 166, 168 of the rail liner 122. A venturi effect is created inside the chamber 146 wherein the air velocity increases and the temperature of the air decreases upon exiting the constricted area 268. Also, a pressure differential is created across the constricted area 268; more particularly a higher pressure area is found upstream of the constricted area 268 and a lower pressure area downstream of the constricted area 268. The air exits the venturi plenum chamber 146 by way of the outflow opening 266 and is directed by the turning vane 264 across the upper surface of the foodstuffs contained in the food bins 148. The air flowing over the food bins 148 forms an air curtain between the foodstuffs and the warmer ambient air. The relatively warmer air enters the inflow opening 270 and is partially directed into the pan cooling chamber 272 by way of vent openings 274 and partially directed into the return plenum chamber 276. Air from the return plenum chamber 276 spills into the refrigerated base chamber 18 and is drawn by a fan (not shown) back into the coil/blower chamber 180 by way of the inlet 184 to be cooled and cycled again.

The venturi constriction 268 of the open-top refrigerated food processing table 10 described above increases the air velocity across the top of the food bins thereby creating an air curtain more resistant to higher ambient temperatures. The open-top refrigerated food processing table 10 of the instant invention efficiently distributes cooled air throughout the food storage compartments and maintains an even temperature throughout the foodstuffs disposed therein. Foodstuffs located in the bottom of the food bins and closer to the coil/blower chamber 180 are kept from freezing by the relatively warmer air circulating through the pan cooling chamber 272. Even with the top cover in the closed position foodstuffs are not adversely affected by extreme temperature fluctuations. Likewise, foodstuffs within the refrigerated base chamber 18 are prevented from freezing, and the contents of all food storage chambers are held at consistently desirable temperatures ranging between 32° and 40° F.

While the invention has been described in connection with a certain specific embodiment thereof, it will be understood that this is by way of illustration and not of limitation, and the scope of the appended claims should be construed as broadly as the prior art will permit.

What is claimed is:

1. An open-top chilling apparatus for maintaining food items at a temperature less than ambient air while providing convenient access to the food items, the open-top chilling apparatus comprising:

a housing defining a plenum chamber and having an open top providing access to the plenum chamber and fluid communication thereof with the ambient air;

a food container having a peripheral wall provided with an upper edge defining an open face and mounted to the housing within the plenum chamber so that the open face is accessible through the open top of the housing, thereby permitting access to the food container through the open top;

a chilled-air source for supplying chilled air to the plenum chamber;

a chilled-air conduit having an inlet opening in fluid communication with the chilled-air source, a discharge opening near the open face of the food container to direct at least a portion of the chilled air across the open face, and a venturi chamber to accelerate the chilled air in the chilled-air conduit so that the speed of the chilled air exiting the chilled-air conduit discharge opening is greater than the speed of the chilled air entering the chilled-air conduit inlet opening, whereby the accelerated chilled air exiting the chilled-air discharge opening forms a curtain of accelerated chilled air across the open face of the food container to effectively separate the ambient air outside the housing from the chilled air within the plenum chamber; and wherein the housing comprises elongated front and rear walls connected by opposing end walls to define the plenum chamber, each wall terminating in an upper edge to define the open top, the chilled-air inlet opening is adjacent to and spans only a portion of the rear wall, and the chilled-air conduit further comprises an air diffuser positioned between the inlet opening and the chilled-air discharge opening to laterally direct the chilled air across a greater span of the rear wall than the span of the inlet opening.

2. An open-top chilling apparatus according to claim 1 and further comprising a return conduit having an inlet near the open face of the food container and an outlet fluidly connected to the chilled-air source wherein the accelerated chilled air passing over the open face of the food container is recirculated through the chilled-air source.

3. An open-top chilling apparatus according to claim 1 wherein the chilled-air source is a refrigeration unit.

4. An open-top chilling apparatus according to claim 3 wherein the refrigeration unit is disposed with the housing.

5. An open-top chilling apparatus according to claim 1 wherein the venturi chamber is a portion of the chilled-air conduit having a reduced cross-sectional area.

6. An open-top chilling apparatus according to claim 5 wherein the reduced cross-sectional area portion is continuously decreasing in cross-sectional area.

7. An open-top chilling apparatus according to claim 6 wherein the reduced cross-sectional area portion terminates at the chilled-air conduit discharge opening.

8. An open-top chilling apparatus according to claim 7 and further comprising an accelerated air deflector extending from the housing above the food container upper edge and the chilled-air conduit discharge opening is positioned below the food container upper edge whereby the accelerated chilled air exiting the chilled-air conduit discharge opening is deflected over the open face of the food container.

9. An open-top chilling apparatus according to claim 1 wherein the diffuser comprises multiple fins extending away from the inlet opening in a fan-shaped pattern and defining multiple laterally directing air-flow paths between adjacent fins to laterally direct the chilled air.

10. An open-top chilling apparatus according to claim 9 wherein the diffuser further comprises a top plate connected to ends of the fins opposite the inlet opening and having multiple apertures through which the laterally directed chilled air exits from the diffuser.

11. An open-top chilling apparatus according to claim 10 wherein the venturi chamber is positioned above the diffuser top plate so that the chilled air exiting the top plate apertures is directed into the venturi chamber.

12. An open-top chilling apparatus according to claim 11 wherein there are multiple food containers mounted in the plenum chamber and the laterally directed chilled air exiting from the apertures of the diffuser and passing through the venturi chamber forms a curtain of accelerated chilled air across the open faces of the multiple food containers.

13. An open-top chilling apparatus according to claim 11 wherein a portion of at least one of the food containers and a portion of the rear wall form a portion of the discharge opening, and the venturi chamber is positioned in the chilled-air conduit below the discharge opening.

14. An open-top chilling apparatus according to claim 13 and further comprising an accelerated air deflector extending from the rear wall above the food container upper edge whereby the accelerated chilled air exiting the chilled-air conduit discharge opening is deflected over the open face of the food container.

15. An open-top chilling apparatus according to claim 11 and further comprising a return conduit having an inlet near the open face of the food container and an outlet in fluid communication with the chilled-air source wherein the accelerated chilled air passing over the open face of the food containers is recirculated through the chilled-air source.

16. An open-top chilling apparatus according to claim 15 wherein a portion of food container and a portion of the front wall define a portion of the return conduit inlet.

17. An open-top chilling apparatus according to claim 1 wherein the food container peripheral wall includes a front wall portion and a rear wall portion and further comprising an air deflector provided within the plenum and having a front side provided with an upper edge thereof and a rear side provided with an upper edge thereof, the front-side upper edge supporting the front wall portion of the food container and the rear-side upper edge extending at least partially up the rear wall portion of the food container.

18. An open-top chilling apparatus according to claim 17 wherein the deflector further comprises a bottom wall connecting the front side and the rear side and mounting the chilled-air source.

19. An open-top chilling apparatus according to claim 18 wherein the deflector front side is spaced from the housing front wall to define a return conduit fluidly connecting the portion of the plenum chamber above the open face of the container to the chilled-air source to define a return conduit.

20. An open-top chilling apparatus according to claim 19 wherein a portion of the deflector rear side and the housing rear wall form the venturi chamber.

21. An open-top chilling apparatus according to claim 20 wherein at least one of said deflector rear-side portion and the housing rear wall converges towards the other to define a continuously decreasing cross-sectional area forming the venturi chamber.

22. An open-top chilling apparatus according to claim 21 wherein the diffuser comprises multiple fins extending away from the inlet opening in a fan-shaped pattern and terminating in a top plate having multiple exit apertures positioned below the venturi chamber.

23. An open-top chilling apparatus according to claim 22 wherein there are multiple food containers, a portion of at least one of the food containers and a portion of the rear wall form a portion of the discharge opening of the chilled-air conduit, and the venturi chamber is positioned in the chilled-air conduit below the discharge opening.

24. An open-top chilling apparatus according to claim 23 and further comprising an accelerated air deflector extending from the rear wall above the food container upper edges whereby the accelerated chilled air exiting the chilled-air conduit discharge opening is deflected by the deflector over the open face of the food container.

25. An open-top chilling apparatus according to claim 24 wherein the housing further comprises a chilled storage area positioned below the plenum chamber and having an access opening closed by a movable door.

26. An open-top chilling apparatus according to claim 25 and further comprising a work surface mounted to the housing above the chilled storage area access opening and extending away from the housing chamber front wall.

27. A refrigerated food preparation table for maintaining food items at a chilled temperature less than the ambient air temperature while providing convenient access to the food items, the refrigerated food preparation table comprising:

a housing having a base supporting an upper portion provided with elongated front and rear walls connected by end walls to define a plenum chamber, each wall terminating in an upper edge to define an open top providing access to the plenum chamber and fluid communication thereof with the ambient air;

a food container disposed in the plenum chamber and having an open face, the food container being mounted to the housing within the plenum chamber so that the open face is accessible through the open top of the housing, thereby permitting access to the food container through the open top;

a food preparation surface extending from the housing;

a refrigeration unit provided in the base for supplying chilled air to the plenum chamber;

a chilled-air conduit having an inlet opening in fluid communication with the refrigeration unit, a discharge opening near the open face of the food container to direct at least a portion of the chilled air across the open face of the food container, and a venturi chamber to accelerate the chilled-air in the chilled-air conduit so that the speed of the chilled air exiting the chilled-air conduit discharge opening is greater than the speed of the chilled air entering the chilled-air conduit inlet opening, whereby the accelerated chilled air exiting the chilled-air discharge opening forms a curtain of accelerated chilled air across the open face of the food container to effectively separate the ambient air outside the housing from the chilled air within the plenum chamber;

wherein the air inlet opening is adjacent to and spans only a portion of the rear wall, and the chilled-air conduit further comprises an air diffuser positioned between the inlet opening and the chilled-air discharge opening to laterally direct the chilled air across a greater span of the rear wall than the span of the inlet opening and into the venturi chamber;

wherein the diffuser comprises multiple fins extending away from the inlet opening in a fan-shaped pattern and terminating in a top plate having multiple exit apertures positioned below the venturi chamber; and and further comprising an air deflector provided within the plenum and having a front side with an upper edge and a rear side with an upper edge connected by a bottom wall, the front side upper edge supporting the front wall portion of the food container and spaced from the housing front wall to define a return conduit for directing the accelerated chilled air passing over the open face of the food container into the housing base to be recirculated by the refrigeration unit, and the rear side having a portion converging relative to the rear wall to define a reduced cross-sectional area forming the venturi chamber.

28. A refrigerated food preparation table according to claim 27 wherein the venturi chamber is a portion of the chilled-air conduit having a reduced cross-sectional area.

29. A refrigerated food preparation table according to claim 28 wherein the reduced cross-sectional area portion is continuously decreasing in cross-sectional area.

30. A refrigerated food preparation table according to claim 29 wherein the reduced cross-sectional area portion terminates at the chilled-air conduit discharge opening.

31. A refrigerated food preparation table according to claim 27 wherein there are multiple food containers, a portion of at least one of the food containers and a portion of the rear wall form a portion of the discharge opening, of the chilled-air conduit, and the venturi chamber is positioned in the chilled-air conduit below the discharge opening.

32. A refrigerated food preparation table according to claim 31 and further comprising an accelerated-air deflector extending from the rear wall above the food container upper edges whereby the accelerated chilled air exiting the chilled-air conduit discharge opening is deflected over the open face of the food container.

33. A refrigerated food preparation table according to claim 32 wherein the base defines a refrigerated storage having at least one access opening closed by a moveable door.

34. A refrigerated food preparation table according to claim 33 wherein the refrigeration unit has an air cooling assembly containing an evaporator coil suspended from the air deflector bottom wall and an inlet opening near the return conduit and an outlet opening connected to the inlet opening of the chilled-air conduit to define an air circulation path from the air cooling assembly, through the chilled-air conduit, across the open face of the food container, and returning through the return conduit.

35. A refrigerated food preparation table according to claim 33 wherein there are multiple food containers.

36. A refrigerated food preparation table according to claim 35 wherein at least one of the food containers is formed with a peripheral wall having a front edge thereof supported on the front wall of the air deflector and a rear edge supported on a support rod spaced from the housing rear wall.

37. A refrigerated food preparation table according to claim 35 wherein the peripheral wall if formed with an upper edge and a lower edge, the front edge being a portion of the upper edge and the rear edge is a portion of the lower edge.

38. An open-top chilling apparatus for maintaining food items at a temperature less than ambient air while providing convenient access to the food items, the open-top chilling apparatus comprising:

a housing defining a plenum chamber comprising elongated front and rear walls connected by opposing end walls to define the plenum chamber, each wall terminating in an upper edge to define an open top providing access to the plenum chamber and fluid communication thereof with the ambient air;

a food container having a peripheral wall provided with an upper edge defining an open face and mounted to the housing within the plenum chamber so that the open face is accessible through the open top of the housing, thereby permitting access to the food container through the open top;

a chilled-air source for supplying chilled air to the plenum chamber;

a chilled-air conduit comprising an inlet opening in fluid communication with the chilled-air source and adjacent to and spanning only a portion of the rear wall, a discharge opening near the open face of the food container to direct at least a portion of the chilled air across the open face, and an air diffuser positioned between the inlet opening and the chilled-air discharge opening to laterally direct the chilled air across a greater span of the rear wall than the span of the inlet opening; and a venturi chamber to accelerate the chilled air in the chilled-air conduit so that the speed of the chilled air exiting the chilled-air conduit discharge opening is accelerated to form a curtain of accelerated chilled air across the open face of the food container to effectively separate the ambient air outside the housing from the chilled air within the plenum chamber.

39. An open-top chilling apparatus according to claim 38 wherein the diffuser comprises multiple fins extending away from the inlet opening in a fan-shaped pattern and defining multiple laterally directing air-flow paths between adjacent fins to laterally direct the chilled air.

40. An open-top chilling apparatus according to claim 39 wherein the diffuser further comprises a top plate connected to ends of the fins opposite the inlet opening and having multiple apertures through which the laterally directed chilled air exits from the diffuser.

41. An open-top chilling apparatus according to claim 40 wherein a venturi chamber is positioned above the diffuser top plate so that the chilled air exiting the top plate apertures is directed into the venturi chamber.

42. An open-top chilling apparatus according to claim 38 and further comprising an accelerated air deflector extending from the rear wall above the food container upper edge whereby the accelerated chilled air exiting the chilled-air conduit discharge opening is deflected over the open face of the food container.

43. An open-top chilling apparatus according to claim 38 and further comprising a return conduit having an inlet near the open face of the food container and an outlet in fluid communication with the chilled-air source wherein the accelerated chilled air passing over the open face of the food containers is recirculated through the chilled-air source.

44. An open-top chilling apparatus according to claim 38 wherein the food container peripheral wall includes a front wall portion and a rear wall portion and further comprising an air deflector provided within the plenum and having a front side provided with an upper edge thereof and a rear side provided with an upper edge thereof, the front side upper edge supporting the front wall portion of the food container and the rear-side upper edge extending at least partially up the rear wall portion of the food container.

45. An open-top chilling apparatus according to claim 44 wherein the deflector further comprises a bottom wall connecting the front side and the rear side and mounting the chilled-air source.

46. An open-top chilling apparatus according to claim 45 wherein the deflector front side is spaced from the housing front wall to define a return conduit fluidly connecting the portion of the plenum chamber above the open face of the container to the chilled-air source to define a return conduit.

47. An open-top chilling apparatus according to claim 38 wherein the venturi chamber is a portion of the chilled-air conduit having a reduced cross-sectional area.

48. An open-top chilling apparatus according to claim 47 wherein the reduced cross-sectional area portion is continuously decreasing in cross-sectional area.

49. An open-top chilling apparatus according to claim 48 wherein the reduced cross-sectional area portion terminates at the chilled-air conduit discharge opening.

50. An open-top chilling apparatus according to claim 49 and further comprising an accelerated air deflector extending from the housing above the food container upper edge and the chilled-air conduit discharge opening is positioned below the food container upper edge whereby the accelerated chilled air exiting the chilled-air conduit discharge opening is deflected over the open face of the food container.

51. A refrigerated food preparation table for maintaining food items at a chilled temperature less than the ambient air temperature while providing convenient access to the food items, the refrigerated food preparation table comprising:

a housing having a base supporting an upper portion provided with elongated front and rear walls connected by end walls to define a plenum chamber, each wall terminating in an upper edge to define an open top providing access to the plenum chamber and fluid communication thereof with the ambient air;

a food container disposed in the plenum chamber and having an open face, the food container being mounted to the housing within the plenum chamber so that the open face is accessible through the open top of the housing, thereby permitting access to the food container through the open top;

a food preparation surface extending from the housing;

a refrigeration unit provided in the base for supplying chilled air to the plenum chamber;

a chilled-air conduit having an inlet opening in fluid communication with the refrigeration unit, a discharge opening near the open face of the food container to direct at least a portion of the chilled air across the open face of the food container;

a venturi chamber to accelerate the chilled-air in the chilled-air conduit so that the speed of the chilled air exiting the chilled-air conduit discharge opening is accelerated to form a curtain of accelerated chilled air across the open face of the food container to effectively separate the ambient air outside the housing from the chilled air within the plenum chamber; and an air deflector provided within the plenum and having a front side with an upper edge and a rear side with an upper edge connected by a bottom wall, the front side upper edge supporting the front wall portion of the food container and spaced from the housing front wall to define a return conduit for directing the accelerated chilled air passing over the open face of the food container into the housing base to be recirculated by the refrigeration unit, and the rear side having a portion converging relative to the rear wall to define a reduced cross-sectional area forming the venturi chamber.

52. A refrigerated food preparation table according to claim 51 wherein the air inlet opening is adjacent to and spans only a portion of the rear wall, and the chilled-air conduit further comprises an air diffuser positioned between the inlet opening and the chilled-air discharge opening to laterally direct the chilled air across a greater span of the rear wall than the span of the inlet opening and into the venturi chamber.

53. A refrigerated food preparation table according to claim 51 wherein the diffuser comprises multiple fins extending away from the inlet opening in a fan-shaped pattern and terminating in a top plate having multiple exit apertures positioned below the venturi chamber.

54. A refrigerated food preparation table according to claim 51 and further comprising an accelerated-air deflector extending from the rear wall above the food container upper edges whereby the accelerated chilled air exiting the chilled-air conduit discharge opening is deflected over the open face of the food container.

* * * * *

UNITED STATES PATENT AND TRADEMARK OFFICE

CERTIFICATE OF CORRECTION

PATENT NO. : 6,089,036
DATED : July 18, 2000
INVENTOR(S) : Terry Carlson, William J. Knapp, and Alois Weisser It is certified that error appears in the above-identified patent and that said Letters Patent is hereby corrected as shown below:

Column 12, claim 31,
Line 22, "opening," should read —opening—.

Column 13, claim 44,
Line 55, "front side" should read —front-side—.

Signed and Sealed this

Tenth Day of July, 2001

Nicholas P. Godici

*Attest:*

*Attesting Officer*

NICHOLAS P. GODICI
*Acting Director of the United States Patent and Trademark Office*